US006633320B2

(12) United States Patent
Sogabe et al.

(10) Patent No.: US 6,633,320 B2
(45) Date of Patent: Oct. 14, 2003

(54) MULTI-GRADATION RECORDING METHOD AND THERMAL TRANSFER RECORDING MEDIUM USED IN THE METHOD

(75) Inventors: Jun Sogabe, Osaka (JP); Fumio Uetsuji, Osaka (JP); Yoshiyuki Asabe, Tokyo-to (JP); Yasutoshi Inoue, Tokyo-to (JP)

(73) Assignees: Fujicopian Co., Ltd., Osaka-Fu (JP); Alps Electric Co., Ltd., Tokyo-to (JP)

( * ) Notice: Subject to any disclaimer, the term of this patent is extended or adjusted under 35 U.S.C. 154(b) by 152 days.

(21) Appl. No.: 09/833,723

(22) Filed: Apr. 12, 2001

(65) Prior Publication Data

US 2001/0055056 A1 Dec. 27, 2001

(30) Foreign Application Priority Data

Apr. 13, 2000 (JP) ..... 2000-112636

(51) Int. Cl.[7] ..... B41J 2/355
(52) U.S. Cl. ..... 347/183
(58) Field of Search ..... 347/183, 187, 347/188, 193, 191; 400/120.07, 120.09, 120.11; 346/33 ME

(56) References Cited

U.S. PATENT DOCUMENTS 5,453,775 A * 9/1995 Eguchi et al. ..... 346/33 ME
5,480,704 A 1/1996 Sogabe ..... 428/212
5,539,442 A * 7/1996 Hitoshi ..... 347/183
5,888,632 A 3/1999 Yamanaka et al. ..... 428/212
6,384,895 B1 * 5/2002 Sawano ..... 347/183
6,417,878 B2 * 7/2002 Tourai et al. ..... 347/183

* cited by examiner

*Primary Examiner*—John S. Hilten
*Assistant Examiner*—K. Feggins
(74) *Attorney, Agent, or Firm*—Fish & Neave

(57) ABSTRACT

A multi-gradation recording method comprising the steps of: providing a thermal transfer recording medium comprising a substrate, a release layer, a first ink layer and a second ink layer provided in this order on the substrate, and carrying out a gradation recording using the thermal transfer recording medium, the step of carrying out a gradation recording comprising: (a) in the case of recording in a middle density/high density region, carrying out a gradation expression based on an area gradation expression by transferring the first ink layer and the second ink layer together, and (b) in the case of recording in a low density region, carrying out a gradation expression by transferring only the second ink layer by causing a cohesive failure in the second ink layer, thereby changing the area of transferred ink per one dot and the thickness of transferred ink dots.

9 Claims, 2 Drawing Sheets

MULTI-GRADATION RECORDING METHOD AND THERMAL TRANSFER RECORDING MEDIUM USED IN THE METHOD

BACKGROUND OF THE INVENTION

The present invention relates to a multi-gradation recording method according to a thermal transfer recording system and a thermal transfer recording medium to be used for the method. More particularly, the present invention relates to a multi-gradation recording method for forming a color image with multi-gradation, wherein gradation recording is carried out by transferring an ink layer to an image receiving body using a thermal printer and a thermal transfer recording medium to be employed for the multi-gradation recording method.

Recording according to a thermal transfer recording method using a thermal printer is a dot recording and a gradation with dots can be expressed in terms of, for example, the density of dots (number of dots per unit area) or the size of dots utilizing a halftone dot effect. As the gradation expression utilizing a halftone dot effect, the following are available: (1) a density gradation method wherein the thickness of ink dots transferred from an ink layer is changed while keeping the area of each dot constant; (2) an area gradation method (so-called "dither method") wherein one pixel is composed of a plurality of dots (matrix) arranged in a zigzag pattern and the number of dots in one pixel is changed while keeping the thickness of transferred ink dots constant (i.e., binary recording); (3) an area gradation method (so-called "variable dot method") wherein the area of dots is changed while keeping the thickness of transferred ink dots constant; and the like.

As the density gradation method (1), JP, A, 58-185294 discloses a method for expressing a gradation of a middle tone using a thermal transfer recording medium in which a plurality of ink layers with different reflective optical densities are stacked on a substrate such that the reflective optical densities and melting points of the ink layers are lowered as ink layers are more removed from the substrate. However, since the binders of the plurality of ink layers are similar types of materials such as waxes, even if transfer of only the uppermost pale color layer is tried, the layer is mixed with an ink layer thereunder. This results in a problem in that transfer of portions of the ink layer thereunder occurs together. Even if a significant difference in melting point between the respective ink layers is provided, it is difficult to control the energy such that a desired ink layer is transferred since the inks are composed of similar types of materials. Hence, a middle tone including a satisfactory gradation in a low density region cannot be reproduced. Further, JP, A, 58-205798 proposes a method for obtaining a high quality gradation expression ranging from a low density to a high density by providing a plurality of thermal transfer recording media with the same color hue and different reflective optical densities and by using a thermal transfer recording media for low density to form dots in a low density region and a thermal transfer recording media for high density to form dots in a high density region. However, in this method, it is necessary to frequently change the thermal transfer recording media and in practice, the method can provide at most about two gradations and cannot provide a satisfactory gradation performance.

In the area gradation method (2) (dither method) changing the density of dots (the number of dots in a matrix), the heating resistors of a thermal head are restricted in size and cannot be made small to a far extent, thereby causing a problem in that the resolution is deteriorated when the area of one pixel is made larger to obtain an image with a large number of gradations.

Recently, the area gradation method (3) changing the area of dots has rapidly spread as an efficient method for obtaining a high-definition full-color image. As thermal transfer recording media suitable for a multi-gradation recording method utilizing only the area gradation method (3), various types of recording media have been proposed (see JP, A, 7-117359 and JP, A, 10-272847). JP, A, 7-117359 discloses that multi-gradation recording is performed using a thermal transfer recording medium having a thinner heat-sensitive ink layer than a conventional one. According to this method, an excellent gradation image can be obtained in a high density/middle density region. However this method has a problem in that, since the reflective optical density per unit area of dots with a size in the neighborhood of that of the minimum transferred dot is not that much different from the reflective optical density per unit area of other bigger transferred dots, the resulting image has a grainy appearance (visually rough impression) due to the small transferred dots.

This conventional technique will be described with reference to the accompanying drawings. FIG. 3 is a partial cross-sectional view showing a thermal transfer recording medium employed for the conventional technique. The thermal transfer recording medium comprises a substrate 11 and a release layer 12 and a heat-sensitive ink layer 13 stacked in this order on one side of the substrate 11. FIG. 4 is a schematic view showing a gradation recording performed on an image receiving body 15 using the thermal transfer recording medium by a variable dot method. In FIG. 4, reference numeral 16 denotes ink dots transferred while being changed in area and excellent gradation performance is obtained in a middle density/high density region MH. However, even by the variable dot method, the size of the minimum dot 17 transferred in binary recording is limited and dots 18 with smaller sizes than the minimum dot 17 cannot be transferred. Moreover, the reflective optical density per unit area of dots with sizes in the neighborhood of the size of the minimum transferred dot is not that different from the reflective optical density per unit area of other bigger transferred dots. Therefore, the gradation performance is not satisfactory in a low density region L and the resulting image gives grainy appearance due to the transferred dots with sizes in the neighborhood of the size of the minimum transferred dot.

It is an object of the present invention to provide a multi-gradation recording method capable of carrying out gradation recording with excellent gradation performance, especially in a low density region, without giving grainy appearance (visually rough impression), thereby obtaining a high-quality full-color image.

Another object of the present invention is to provide a thermal transfer recording medium suitable for the foregoing multi-gradation recording method.

These and other objects of the present invention will become apparent from the description hereinafter.

SUMMARY OF THE INVENTION

The present invention provides the following multi-gradation recording methods and thermal transfer recording media used in the methods:

(1) A multi-gradation recording method for carrying out multi-gradation recording according to a thermal transfer recording method, comprising selectively heating a thermal transfer recording medium from the rear side thereof with a thermal head to transfer an ink layer thereon on a dot basis to an image receiving body, the multi-gradation recording method comprising the steps of:

providing a thermal transfer recording medium comprising a substrate, a release layer, a first ink layer and a second ink layer provided in this order on the substrate, and carrying out a gradation recording using the thermal transfer recording medium, the step of carrying out a gradation recording comprising:

(a) in the case of recording in a middle density/high density region, carrying out a gradation expression based on an area gradation expression by transferring the first ink layer and the second ink layer together, and (b) in the case of recording in a low density region, carrying out a gradation expression by transferring only the second ink layer by causing a cohesive failure in the second ink layer, thereby changing the area of transferred ink per one dot and the thickness of transferred ink dots.

(2) The multi-gradation recording method of the above (1), wherein the release layer comprises a wax as a main component by weight, each of the first ink layer and the second ink layer comprises a coloring agent and a binder, each of the binder in the first ink layer and the binder of the second ink layer comprises a thermoplastic resin as a main component by weight, the thermoplastic resin as the main component of the binder of the first ink layer and the thermoplastic resin as the main component of the binder of the second ink layer are substantially incompatible with each other, the release layer has a melting point of 60° to 120° C. and a heat of fusion of 100 mJ/mg or more, the binder of the second ink layer has a softening point of 50° to 90° C. and a tensile strength (JIS K 6760 and JIS K 7113) of smaller than 200 kg/cm$^2$, and the binder of the first ink layer has a softening point higher than the softening point of the binder of the second ink layer and a tensile strength (JIS K 6760 and JIS K 7113) of not smaller than 200 kg/cm$^2$.

(3) The multi-gradation recording method of the above (2), wherein the binder of the second ink layer comprises at least one member of an ethylene-vinyl acetate copolymer and an ethylene-ethyl acrylate copolymer as a main component by weight.

(4) The multi-gradation recording method of the above (2) or (3), wherein the content (g/m$^2$) of the coloring agent per unit area in the first ink layer is higher than the content (g/m$^2$) of the coloring agent per unit area in the second ink layer.

(5) The multi-gradation recording method of any one of the above (2) to (4), wherein the thermal transfer recording medium has a total thickness including the thickness of the substrate of not more than 5.0 $\mu$m.

(6) A thermal transfer recording medium used in a multi-gradation recording method of the above (1), comprising a substrate, a release layer, a first ink layer and a second ink layer provided in this order on the substrate, wherein the release layer comprises a wax as a main component by weight, each of the first ink layer and the second ink layer comprises a coloring agent and a binder, each of the binder in the first ink layer and the binder of the second ink layer comprises a thermoplastic resin as a main component by weight, the thermoplastic resin as the main component of the binder of the first ink layer and the thermoplastic resin as the main component of the binder of the second ink layer are substantially incompatible with each other, the release layer has a melting point of 60° to 120° C. and a heat of fusion of 100 mJ/mg or more, the binder of the second ink layer has a softening point of 50° to 90° C. and a tensile strength (JIS K 6760 and JIS K 7113) of smaller than 200 kg/cm$^2$, and the binder of the first ink layer has a softening point higher than the softening point of the binder of the second ink layer and a tensile strength (JIS K 6760 and JIS K 7113) of not smaller than 200 kg/cm$^2$.

(7) The thermal transfer recording medium of the above (6), wherein the binder of the second ink layer comprises at least one member of an ethylene-vinyl acetate copolymer and an ethylene-ethyl acrylate copolymer as a main component by weight.

(8) The thermal transfer recording medium of the above (6) or (7), wherein the content (g/m$^2$) of the coloring agent per unit area in the first ink layer is higher than the content (g/m$^2$) of the coloring agent per unit area in the second ink layer.

(9) The thermal transfer recording medium of any one of the above (6) to (8), which has a total thickness including the thickness of the substrate of not more than 5.0 $\mu$m.

DETAILED DESCRIPTION

As described above, the area gradation method according to the variable dot method can provide an excellent gradation expression in a high density/middle density region by changing the areas of dots. In a low density region, however, the reflective optical density per unit area of dots with sizes in the neighborhood of the size of the minimum transferred dot is not that different from the reflective optical density per unit area of other bigger transferred dots, thereby resulting in graininess (visually rough impression) due to the transferred dots with sizes in the neighborhood of the size of the minimum transferred dot.

The present inventors have considered it difficult to solve the above graininess problem in the low density region by using a single ink layer as the color ink layer because of the limitation of the minimum transferred dot. As a result of intensive investigation, the present inventors have discovered that the foregoing problems can be solved by a method for performing gradation expression in which a thermal transfer recording medium having a color ink layer of double-layer structure is employed as compared with a conventional thermal transfer recording method. A gradation expression in a middle density/high density region is carried out by an area gradation wherein these two ink layers are transferred together and a gradation expression in a low density region is carried out mainly by a combination of an area gradation and a density gradation wherein only one ink layer out of two ink layers on the thermal transfer recording medium is used.

That is, the multi-gradation recording method of the present invention is characterized by a multi-gradation recording method according to a thermal transfer recording method comprising selectively heating a thermal transfer recording medium from the rear side thereof by a thermal head to transfer an ink layer thereon on a dot basis to an image receiving body, the multi-gradation recording method comprising the steps of:

providing a thermal transfer recording medium comprising a substrate, a release layer, a first ink layer and a second ink layer provided in this order on the substrate, and carrying out a gradation recording using the thermal transfer recording medium, the step of carrying out a gradation recording comprising:

(a) in the case of recording in a middle density/high density region, carrying out a gradation expression based on an area gradation expression by transferring the first ink layer and the second ink layer together, and (b) in the case of recording in a low density region, carrying out a gradation expression by transferring only the second ink layer by causing a cohesive failure in the second ink layer, thereby changing the area of transferred ink per one dot and the thickness of transferred ink dots.

Figure 1:
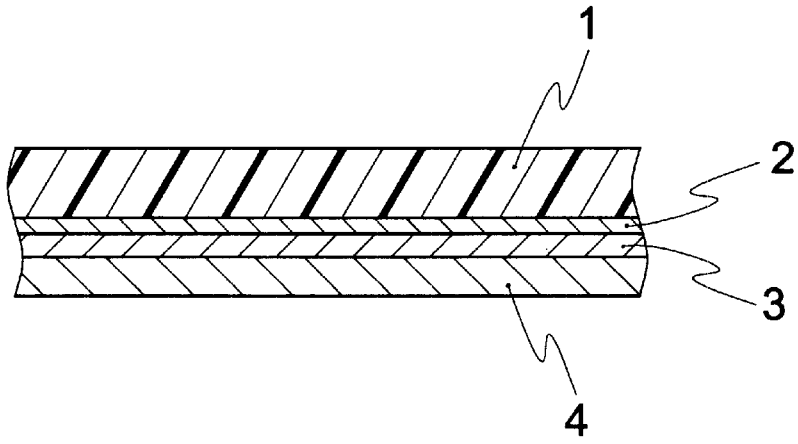
FIG. 1 is a partial cross-sectional view showing a thermal transfer recording medium used in a multi-gradation recording method according to the present invention.
Figure 2:
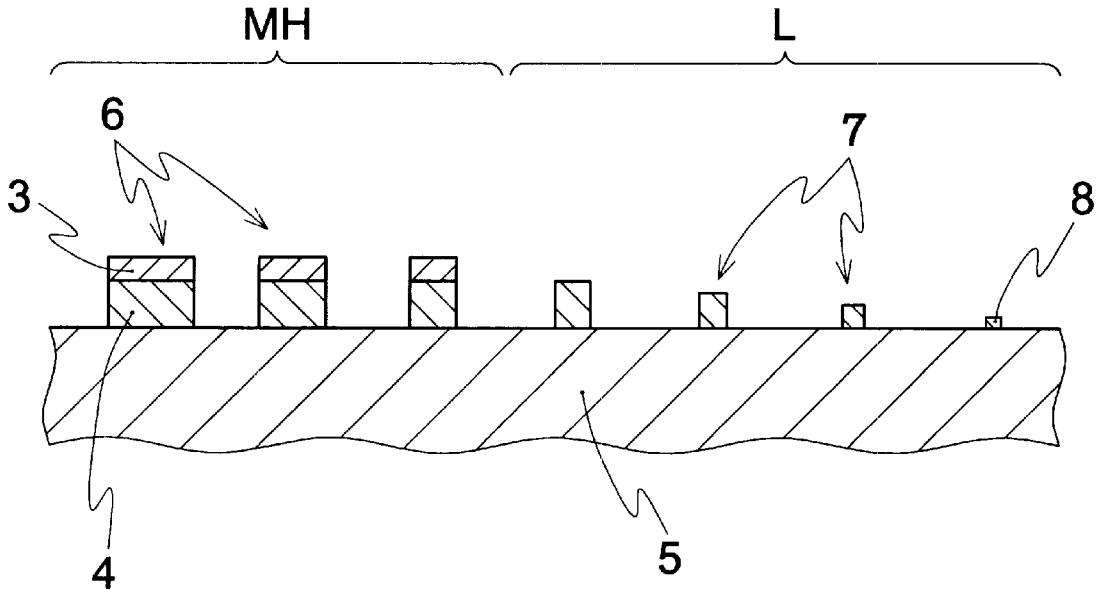
FIG. 2 is a schematic view showing a gradation recording performed on an image receiving body by a multi-gradation recording method according to the present invention.
Figure 3:
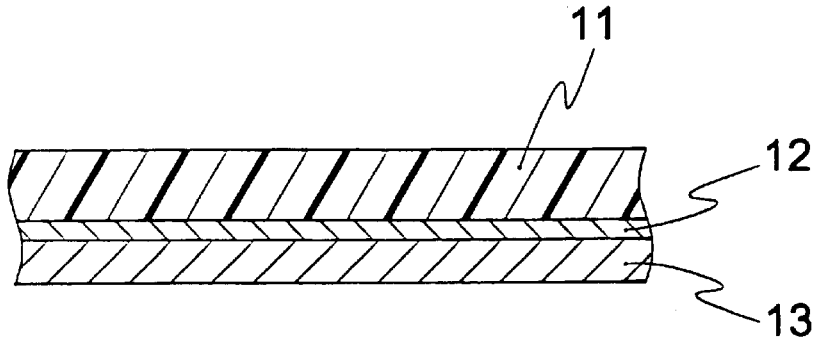
FIG. 3 PRIOR ART
FIG. 3 is a partial cross-sectional view showing a thermal transfer recording medium used in a conventional multi-gradation recording method.
Figure 4:
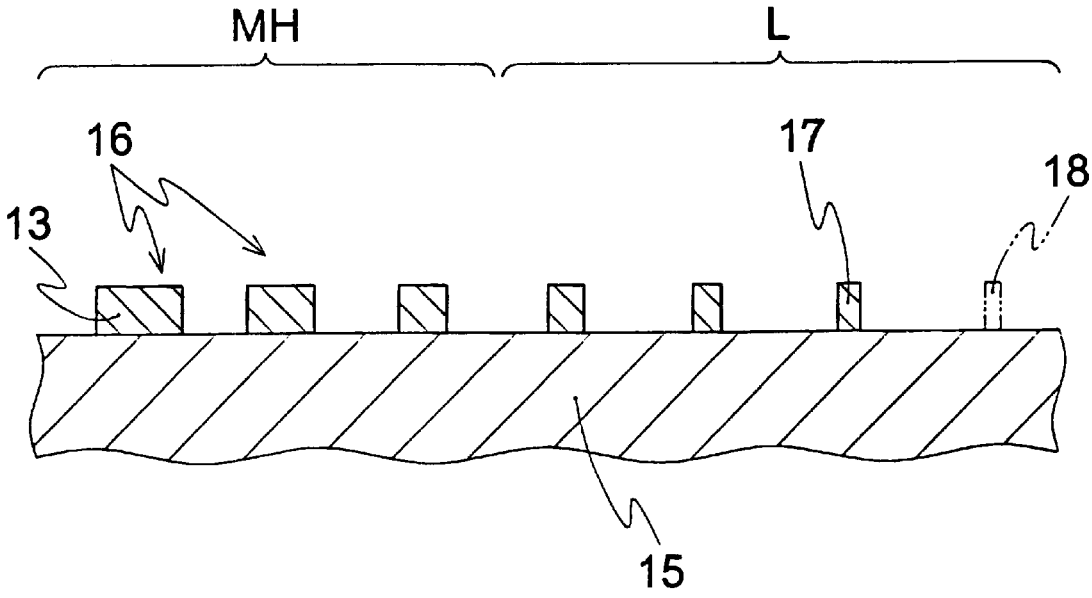
FIG. 4 PRIOR ART
FIG. 4 is a schematic view showing a gradation recording performed on an image receiving body by a conventional multi-gradation recording method.

The multi-gradation recording method of the present invention will be described with reference to the accompanying drawings. FIG. 1 is a partial cross-sectional view showing a thermal transfer recording medium used in the multi-gradation recording method of the present invention. The thermal transfer recording medium comprises a substrate 1, a release layer 2 provided on one side of the substrate 1, a first ink layer 3 and a second ink layer 4 provided in this order on the release layer 2. FIG. 2 shows a gradation recording carried out on an image receiving body 5 using the thermal transfer recording medium by a variable dot method. In FIG. 2, in a middle density/high density region MH, a gradation expression is performed based on an area gradation by binary recording wherein the first ink layer 3 and the second ink layer 4 are transferred together. In this case, the areas of the transferred dots 6 are changed. In such a manner, an excellent gradation performance is achieved in the middle density/high density region. In a low density region L, a gradation expression is performed by transferring only the second ink layer by causing a cohesive failure in the second ink layer, thereby changing the area of transferred ink per one dot and the thickness of transferred ink dots. Transferred dots 8 among the transferred dots 7 in the low density region L correspond to the dots 18 which are not transferable in the prior art illustrated in FIG. 4. In the present invention, since ink dots are transferred by cohesive failure within the layer of the second ink layer, transferred dots with a small size can be obtained. Further, since transfer of the second ink layer is carried out in such a manner that the transferred ink dots have different thicknesses, the reflective optical density per unit area of dots with sizes in the neighborhood of the size of the minimum transferred dot can be made lower than the reflective optical density per unit area of other bigger transferred dots. Consequently, in the low density region L, a satisfactory gradation performance is obtained and graininess (visually rough impression) due to the transferred dots with sizes in the neighborhood of the size of the minimum transferred dot is not observed.

As described above, the gradation expression in the multi-gradation recording method of the present invention is carried out as follows: in the case of recording in a middle density/high density region, a gradation expression based on an area gradation expression is carried out by transferring the first ink layer and the second ink layer together. In the case of recording in a low density region, a gradation expression is carried by causing a cohesive failure in the second ink layer to transfer only the second ink layer partially in the thickness direction thereof, thereby changing the area of transferred ink per one dot and the thickness of transferred ink dots. Generally, in the case of the middle density/high density region, the reflective optical density (OD value) of an image is 0.10 or higher and in the case of the low density region, the reflective optical density is lower than 0.10. However, they are not necessarily limited to such ranges.

In the middle/high density region, the gradation expression is carried out by an area gradation method. Examples of usable area gradation methods include an area gradation method (dither method) wherein the number of dots in one pixel is changed, an area gradation method (variable dot method) wherein the area of dots is changed, and a combination of these methods. In the low density region, the gradation expression is carried out by causing a cohesive failure in the second ink layer to transfer only the second ink layer partially in the thickness direction thereof, thereby changing the area of transferred ink per one dot and the thickness of transferred ink. That is, the gradation expression is based on a combination of an area gradation and a density gradation. In this case, such a combination of the area gradation and the density gradation denotes a main embodiment (A) wherein the area and the thickness of transferred dots are simultaneously changed dot by dot. However, an embodiment (B) wherein only the area of dots is changed and/or an embodiment (C) wherein only the thickness of dots is changed may be involved in addition to the main embodiment (A).

In the multi-gradation recording method of the present invention, in the case of carrying out recording in the middle density/high density region, the first ink layer and the second ink layer must be simultaneously transferred, and in the case of carrying out recording in the low density region, the transfer of only the second ink layer by cohesive failure in the second layer is required. Such transfer can be achieved by controlling the amount of energy supplied to a thermal head and/or adjusting the materials and physical properties of the first ink layer and the second ink layer.

In the multi-gradation recording method of the present invention, it is preferable to use the following thermal transfer recording medium in order to easily perform the foregoing transfer modes.

The thermal transfer recording medium of the present invention comprises a substrate, a release layer, a first ink layer and a second ink layer provided in this order on the substrate. The release layer comprises a wax as a main component by weight. The first ink layer and the second ink layer are heat-sensitive transfer ink layers each comprising a coloring agent and a binder. The binder comprises a thermoplastic resin as a main component by weight. The thermal transfer recording medium of the present invention is designed such so that only the second ink layer is transferred by a small amount of heat energy in the low density region. When the second ink layer is transferred, the release layer and the first ink layer must not melt or soften. Therefore, the softening point of the binder of the first ink layer is preferably higher than the softening point of the binder of the second ink layer, and the melting point of the release layer is also preferably higher than the softening point of the binder of the second ink layer. Incidentally, even in the case that the melting point of the release layer comprising a wax as a main component is equal to or lower than the softening point of the binder of the second ink layer, it is possible to soften only the second ink layer and to prevent the release layer from melting depending on the transfer conditions when a wax having a heat of fusion of 100 mJ/mg or more is used in the release layer, since the heat of fusion of the thermoplastic resin (which is a main component of the binder of the second ink layer) is generally as low as 10 to 50 mJ/mg due to resins.

In order to ensure the transfer of only the second ink layer, it is preferable that the thermoplastic resin as a main component of the binder of the first ink layer and the thermoplastic resin as a main component of the binder of the second ink layer are substantially incompatible with each other. Examples of two kinds of resins incompatible with each other include resins having mutually different solubility parameters (hereinafter, referred as to "SP value"). For example, in the case of using an ethylene-vinyl acetate copolymer (SP value: 8 to 8.7) as a main component of the binder of the second ink layer, a polyamide resin (SP value: 13.6), an acrylic resin (SP value: 13), an urethane resin (SP value: 10.5), or the like is used as a main component of the binder of the first ink layer.

Determination of the compatibility of the resins can be made by the following method. Two resins are dissolved in a ratio of 1:1 by weight in an organic solvent, such as toluene or the like, in which both can be dissolved. The resulting solution is spread on a slide glass and dried at a room temperature to form a film. The resins are compatible if the film is transparent and incompatible if the film is opaque.

If mutually compatible resins are used as a main component of the binder of the first ink layer and a main component of the binder of the second ink layer, a drawback is that the first ink layer is also easily transferred when transferring the second ink layer in the low density region.

Further, in order to ensure the transfer of only the second ink layer more reliably, it is preferable that a binder having a tensile strength (JIS K 6760 and JIS A 7113, hereinafter the same) of not smaller than 200 kg/cm$^2$ is used as the binder for the first ink layer to increase the inner cohesive force of the first ink layer and a binder having a tensile strength of smaller than 200 kg/cm$^2$ is used as the binder for the second ink layer. Consequently, the first ink layer is not broken due to its high inner cohesive force and is not transferred when transferring the second ink layer. The tensile strength of the binder of the first ink layer is preferably not greater than 1,000 kg/cm$^2$ from the viewpoint of the transfer performance in the middle density/high density region.

In order to transfer the second ink layer by causing cohesive failure in the layer when transferring only the second ink layer, the binder of the second ink layer preferably has a softening point of 50° to 90° C. and a tensile strength of smaller than 200 kg/cm$^2$. If the softening point of the binder of the second ink layer is lower than 50° C., a blocking tends to occur during storage of the thermal transfer recording medium. If the softening point of the binder exceeds 90° C., the sensitivity for the transfer with a small amount of heat energy in the low density region tends to become insufficient, thereby making it difficult to transfer only the second ink layer. By using the binder with a tensile strength of smaller than 200 kg/cm$^2$, the inner cohesive force of the second ink layer is decreased making possible the transfer due to cohesive failure. The tensile strength of the binder of the second ink layer is more preferably not greater than 100 kg/cm$^2$.

In terms of the transfer sensitivity, the release layer preferably has a melting point of 60° to 120° C.

Hereinafter, the constituent materials for the respective ink layers will be described in detail. The heat-sensitive transferable release layer used in the present invention comprises a wax as a main component. Waxes used as a main component preferably have a melting point of 60° to 120° C. and a heat of fusion of 100 mJ/mg or more. Such waxes are selected from natural waxes such as Japan wax, beeswax, carnauba wax, candelilla wax, montan wax and ceresin wax, petroleum waxes such as paraffin wax and microcrystalline wax, synthetic waxes such as oxidized waxes and ester waxes, and higher aliphatic acids. They may be used either alone or as a mixture of 2 or more species thereof. In order to control the adhesive strength to the substrate, a thermoplastic resin can be added to the release layer. Examples of such thermoplastic resins are olefin copolymers such as ethylene-vinyl acetate copolymers, polyamide resins, polyester resins, natural rubber, petroleum resins, rosin resins, styrene resins, poly(vinyl alcohol), poly (vinyl butyral), urethane resins, cellulose resins, epoxy resins, and the like. The thickness of the release layer is preferably 0.05 to 1.5 $\mu$m and more preferably 0.1 to 1.0 $\mu$m. If the thickness of the release layer is smaller than the foregoing ranges, the release effect tends to be insufficient and if the thickness exceeds the foregoing ranges, the heat response performance tends to be deteriorated.

As the thermoplastic resin as a main component of the binder of the second ink layer of the present invention, for the same reasons as those for the binder, thermoplastic resins having a softening point of 50° to 90° C. and a tensile strength of smaller than 200 kg/cm$^2$, especially not greater than 100 kg/cm$^2$, are preferred. The content of the thermoplastic resin as the main component in the binder is preferably 50 to 100% by weight in terms of the excellent cohesive failure transfer performance. The thermoplastic resins satisfying such physical properties are selected from olefin copolymers such as ethylene-vinyl acetate copolymer and ethylene-ethyl acrylate copolymer, polyamide resins, polyester resins, natural rubber, petroleum resins, rosin resins, styrene resins, poly(vinyl alcohol), poly(vinyl butyral), urethane resins, and the like. These thermoplastic resins may be used either alone or as a mixture of 2 or more species thereof. Among these resins, at least one member selected from ethylene-vinyl acetate copolymer and ethylene-ethyl acrylate copolymer is especially preferred since the adhesion sensitivity to an image receiving body such as paper is high. In order to adjust the layer strength of the second ink layer, cellulose resins or epoxy resins may be further added. Furthermore, various types of waxes may be added to the second ink layer from the viewpoint of improving the thermal response. Examples of such waxes are natural waxes such as Japan wax, beeswax, carnauba wax, candelilla wax, montan wax and ceresin wax, petroleum waxes such as paraffin wax and microcrystalline wax, synthetic waxes such as oxidized waxes and ester waxes, and higher aliphatic acids. The second ink layer may be further incorporated with particulate components such as silica, silicone oil, a fluorine-containing surfactant, and other lubricating agents for preventing blocking and stains. The thickness of the second ink layer is preferably 0.1 to 1.5 $\mu$m and more preferably 0.1 to 1.0 $\mu$m. If the thickness is smaller than 0.1 $\mu$m, the cohesive failure transfer in the second ink layer tends to become impossible and if the thickness exceeds 1.5 $\mu$m, the thermal response tends to be deteriorated.

As the thermoplastic resin as a main component of the binder of the first ink layer in the present invention, a thermoplastic resin incompatible with the thermoplastic resin, which is the main component of the binder of the second ink layer, is used as mentioned above. Further, as the thermoplastic resin as a main component of the binder of the first ink layer of the present invention, for the same reasons as those for the binder, thermoplastic resins having a softening point of higher than that of the thermoplastic resin as the main component of the binder in the second ink layer and a tensile strength of not smaller than 200 kg/cm$^2$ (preferably not greater than 1,000 kg/cm$^2$) are preferred. The content of the thermoplastic resin as the main component in the binder is preferably 80 to 100% by weight in order to assure the transfer of only the second ink layer in the low density region. The thermoplastic resins satisfying such physical properties are selected from olefin copolymers such as ethylene-vinyl acetate copolymer and ethylene-ethyl acrylate copolymer, polyamide resins, polyester resins, natural rubber, petroleum resins, rosin resins, styrene resins, poly (vinyl alcohol), poly(vinyl butyral), urethane resins, and the like. These thermoplastic resins may be used either alone or as a mixture of 2 or more species thereof. In order to adjust the layer strength of the first ink layer, cellulose resins or epoxy resins may be further added. Furthermore, various types of waxes can be added to the first ink layer from the viewpoint of improving thermal response. Examples of such waxes are natural waxes such as Japan wax, beeswax, carnauba wax, candelilla wax, montan wax and ceresin wax, petroleum waxes such as paraffin wax and microcrystalline wax, synthetic waxes such as oxidized waxes and ester waxes, and higher aliphatic acids. The thickness of the first ink layer is preferably 0.1 to 1.5 $\mu$m and more preferably 0.1 to 1.0 $\mu$m. If the thickness is smaller than the above range, the color density tends to be insufficient and if the thickness is greater than the above range, the thermal response tends to be deteriorated.

Each of the first ink layer and the second ink layer in the present invention contains a coloring agent. A variety of known pigments and dyes can be used as the coloring agent. Examples of the pigments include carbon black, azo pigments, phthalocyanine pigments, quinacridone pigments, thioindigo pigments, anthraquinone pigments, and isoindoline pigments. Two or more types of them can be used in combination, and dyes may be added for adjustment of hue. In the low density region, the gradation expression is carried out by using only the second ink layer and if the color density of the second ink layer is not low, the resulting image is grainy as in the case of using a thermal transfer recording medium for area gradation in the prior art. Consequently, in order to obtain a pale second ink layer, the content (g/m$^2$) of the coloring agent per unit area in the second ink layer is preferably controlled to be lower than the content (g/m$^2$) of the coloring agent per unit area in the first ink layer. More preferably, the content (g/m$^2$) of the coloring agent per unit area in the second ink layer is controlled to be not more than ½ of the content (g/m$^2$) of the coloring agent per unit. area in the first ink layer. Still more preferably, the content (g/m$^2$) of the coloring agent per unit area in the second ink layer is controlled to be not more than ⅓ of the content (g/m$^2$) of the coloring agent per unit area in the first ink layer. The content of the coloring agent per unit area in an ink layer can be calculated by multiplying the coating amount (g/m$^2$) of the ink layer on a dry basis by the content ratio (% by weight) of the coloring agent on the basis of the total weight of the ink layer. By prescribing the content of the coloring agent per unit area in the first and second ink layers in this manner, smooth gradation expression without graininess can be achieved in the low density region. The content ratios of the coloring agent in the first ink layer and the second ink layer are generally 40 to 90% by weight and 1 to 60% by weight, respectively.

In the multi-gradation recording method of the present invention, the thermal energy from a thermal head is extremely slight when transferring only the second ink layer in the low density region. In order to achieve a good response to such slight thermal energy, the total thickness of the thermal transfer recording medium, including the thickness of the substrate and the thickness of a heat-resistant resin layer to be brought into contact with the thermal head, is preferably not greater than 5.0 $\mu$m, more preferably not greater than 4.0 $\mu$m. If the total thickness of the thermal transfer recording medium exceeds the foregoing ranges, it is difficult to respond to changes of thermal energy from the thermal head, resulting in difficulty of the cohesive failure transfer of the second ink layer.

As the substrate to be employed for the thermal transfer recording medium of the present invention, any of a variety of materials used as a substrate for such types of thermal transfer recording media can be employed. Polyester films, especially poly(ethylene terephthalate) film, of 1 to 3 $\mu$m thickness are preferable in terms of the durability, thermal conduction and cost. An especially preferable one is a substrate bearing a heat-resistant resin layer (stick-preventing layer) in the rear side (with which a thermal head is brought into sliding contact). The thickness of the heat-resistant resin layer is generally about 0.05 to 0.5 $\mu$m. However in order to improve the aforesaid thermal response to the thermal head, the thickness of the substrate and the thickness of the heat-resistant resin layer are preferably as thin as possible.

One of requirements for the thermal transfer recording medium of the present invention is a structure comprising a substrate, a release layer, a first ink layer and a second ink layer provided in this order on the substrate. However, if a main component resin of the binder of the first ink layer has a release function in relation to the substrate and a line printer whose printing speed is relatively slow is employed, the effect of the present invention can be achieved even without the release layer.

In the case of forming a full-color image using the multi-gradation recording method of the present invention, for example, such an image can be formed by using a thermal transfer recording medium wherein the first ink layer and the second ink layer are colored in yellow, a thermal transfer recording medium wherein the first ink layer and the second ink layer are colored in magenta, a thermal transfer recording medium wherein the first ink layer and the second ink layer are colored in cyan, and, if necessary, a thermal transfer recording medium wherein the first ink layer and the second ink layer are colored in black, or a thermal transfer recording medium wherein a stacked first ink layer/second ink layer for yellow, a stacked first ink layer/second ink layer for magenta, a stacked first ink layer/second ink layer for cyan, and, if necessary, a stacked first ink layer/second ink layer for black, are provided in a side by side relation on a single substrate; and superimposing multi-gradation images of respective colors formed by the multi-gradation recording method of the present invention.

The present invention will be described in detail by referring to Examples. It is to be understood that the present invention will not be limited to the Examples, and various changes and modifications may be made in the invention without departing from the spirit and scope thereof.

Production of Thermal Transfer Recording Medium

EXAMPLE 1

A poly(ethylene terephthalate) film of 2.5 μm thickness coated with a silicone resin-based stick-preventing layer of 0.2 μm thickness in the rear side was used as a substrate.

The following coating liquid for a release layer was applied onto the foregoing substrate so as to form a layer of 0.7 μm thickness after drying and then dried to form a release layer (melting point: 82° C.; heat of fusion: 180 mJ/mg).

Coating liquid for release layer

| Component | % by weight |
|---|---|
| Paraffin wax (melting point: 75° C.; heat of fusion: 205 mJ/mg) | 7.0 |
| Polyethylene wax (melting point: 100° C.; heat of fusion: 140 mJ/mg) | 3.0 |
| Toluene | 90 |
| Total | 100 |

The following coating liquid for a first ink layer was applied onto the foregoing release layer so as to form a layer of 0.3 μm thickness after drying and then dried to form a first ink layer.

Coating liquid for first ink layer

| Component | % by weight |
|---|---|
| Acrylic resin (softening point: 120° C.; tensile strength: 250 kg/cm$^2$) | 4.0 |
| Phthalocyanine Blue | 6.0 |
| Dispersing agent | 0.3 |
| Isopropyl alcohol | 30 |
| Toluene | 10 |
| Total | 50.3 |

The following coating liquid for a second ink layer was applied onto the foregoing first ink layer so as to form a layer of 0.3 μm thickness after drying and then dried to form a second ink layer.

Coating liquid for second ink layer

| Component | % by weight |
|---|---|
| Ethylene-vinyl acetate copolymer (vinyl acetate content: 28% by weight; melt flow rate: 150, softening point: 63° C.; heat of fusion: 22 mJ/mg; tensile strength: 40 kg/cm$^2$) | 8.0 |
| Phthalocyanine Blue | 1.0 |
| Dispersing agent | 0.3 |
| Silica particles (average particle size: 1.0 μm) | 0.7 |
| Toluene | 40 |
| Total | 50 |

Thus, a thermal transfer recording medium of 4.0 μm total thickness was obtained.

Comparative Example 1

The following coating liquid for an ink layer was applied onto the same release layer as that of Example 1 so as to form a layer of 0.5 μm thickness after drying and then dried to form an ink layer of a single layer structure, yielding a thermal transfer recording medium of 3.9 μm total thickness.

Coating liquid for ink layer

| Component | % by weight |
|---|---|
| Ethylene-vinyl acetate copolymer (vinyl acetate content: 28% by weight; melt flow rate: 150, softening point: 63° C.; heat of fusion: 22 mJ/mg; tensile strength: 40 kg/cm$^2$) | 4.0 |
| Phthalocyanine Blue | 6.0 |
| Dispersing agent | 0.3 |
| Toluene | 40 |
| Total | 50.3 |

Gradation Recording

Using each of the thermal transfer recording media obtained in Example 1 and Comparative Example 1, gradation recording of 256 gradations was carried by modulating the amount of thermal energy applied to each dot in 16 steps in a 4×4 dither pattern.

Printer: a test printer (variable dot type)

Thermal head: 600 dots per inch (edge distance: 100 μm)

Printing speed: 254 mm/sec

Printing energy: printing energy for each dot is changed in 16 steps within a range of 0 to 10 mJ/mm$^2$.

Image receiving sheet: Super Mat Art paper (produced by Mitsubishi Paper Mills, Ltd.)

Results

In the case of Example 1, a gradation image formed according to an area gradation by transfer of the first ink layer and the second ink layer together had a smooth gradation expression covering from a high density region to a middle density region, and a gradation image formed according to an area gradation and a density gradation by transfer of only the second ink layer due to cohesive failure also provided a smooth gradation expression with a lower density in a low density region composed of dots with sizes equal to or smaller than that of one dot (the minimum dot size in the prior art).

In contrast thereto, in case of Comparative Example 1, although a gradation image formed according to an area gradation could achieve a gradation expression covering from a high density region to a low density region, transfer with a lower density in a low density region composed of dots with sizes equal to or smaller than that of one dot (the minimum transfer dot size in the prior art) could not be performed.

In addition to the materials and ingredients used in the Examples, other materials and ingredients can be used in the present invention as set forth in the specification to obtain substantially the same results.

According to the multi-gradation recording method of the present invention which is characterized by providing a thermal transfer recording medium comprising a substrate, a release layer, a first ink layer and a second ink layer provided in this order on the substrate, and carrying out a gradation recording comprising: (a) in the case of recording in a middle density/high density region, carrying out a gradation expression based on an area gradation expression by transferring the first ink layer and the second ink layer together, and (b) in the case of recording in a low density region, carrying out a gradation expression by transferring only the second ink layer by causing a cohesive failure in the second ink layer, thereby changing the area of transferred ink per one dot and the thickness of transferred ink dots, a sharp and smooth gradation image can be obtained in a middle density/high density region and a gradation image having no grainy appearance can be obtained in a low density region, thereby providing a high-quality full-color image with multi-gradation.

What is claimed is:

1. A multi-gradation recording method for carrying out multi-gradation recording according to a thermal transfer recording method comprising selectively heating a thermal transfer recording medium from the rear side thereof by a thermal head to transfer an ink layer thereon on a dot basis to an image receiving body, the multi-gradation recording method comprising the steps of:

providing a thermal transfer recording medium comprising a substrate, a release layer, a first ink layer and a second ink layer provided in this order on the substrate, and carrying out a gradation recording using the thermal transfer recording medium, the step of carrying out a gradation recording comprising:

(a) in a case of recording in a middle density/high density region, carrying out a gradation expression based on an area gradation by transferring the first ink layer and the second ink layer together, and (b) in a case of recording in a low density region, carrying out a gradation expression by transferring only the second ink layer by causing a cohesive failure in the second ink layer, thereby changing the area of transferred ink per one dot and the thickness of transferred ink dots.

2. The multi-gradation recording method of claim 1, wherein the release layer comprises a wax as a main component by weight, each of the first ink layer and the second ink layer comprises a coloring agent and a binder, each of the binder in the first ink layer and the binder of the second ink layer comprises a thermoplastic resin as a main component by weight, the thermoplastic resin as the main component of the binder of the first ink layer and the thermoplastic resin as the main component of the binder of the second ink layer are substantially incompatible with each other, the release layer has a melting point of 60° to 120° C. and a heat of fusion of 100 mJ/mg or more, the binder of the second ink layer has a softening point of 50° to 90° C. and a tensile strength (JIS K 6760) of smaller than 200 kg/cm$^2$, and the binder of the first ink layer has a softening point higher than the softening point of the binder of the second ink layer and a tensile strength (JIS K 6760) of not smaller than 200 kg/cm$^2$.

3. The multi-gradation recording method of claim 2, wherein the binder of the second ink layer comprises at least one member of an ethylene-vinyl acetate copolymer and an ethylene-ethyl acrylate copolymer as a main component by weight.

4. The multi-gradation recording method of claim 2, wherein the content (g/m$^2$) of the coloring agent per unit area in the first ink layer is higher than the content (g/m$^2$) of the coloring agent per unit area in the second ink layer.

5. The multi-gradation recording method of claim 2, wherein the thermal transfer recording medium has a total thickness including the thickness of the substrate of not more than 5.0 $\mu$m.

6. A thermal transfer recording medium used in a multi-gradation recording method of claim 1, comprising a substrate, a release layer, a first ink layer and a second ink layer provided in this order on the substrate, wherein the release layer comprises a wax as a main component by weight, each of the first ink layer and the second ink layer comprises a coloring agent and a binder, each of the binder in the first ink layer and the binder of the second ink layer comprises a thermoplastic resin as a main component by weight, the thermoplastic resin as the main component of the binder of the first ink layer and the thermoplastic resin as the main component of the binder of the second ink layer are substantially incompatible with each other, the release layer has a melting point of 60° to 120° C. and a heat of fusion of 100 mJ/mg or more, the binder of the second ink layer has a softening point of 50° to 90° C. and a tensile strength (JIS K 6760) of smaller than 200 kg/cm$^2$, and the binder of the first ink layer has a softening point higher than the softening point of the binder of the second ink layer and a tensile strength (JIS K 6760) of not smaller than 200 kg/cm$^2$.

7. The thermal transfer recording medium of claim 6, wherein the binder of the second ink layer comprises at least one member of an ethylene-vinyl acetate copolymer and an ethylene-ethyl acrylate copolymer as a main component by weight.

8. The thermal transfer recording medium of claim 6, wherein the content (g/m$^2$) of the coloring agent per unit area in the first ink layer is higher than the content (g/m$^2$) of the coloring agent per unit area in the second ink layer.

9. The thermal transfer recording medium of claim 6, which has a total thickness including the thickness of the substrate of not more than 5.0 $\mu$m.

* * * * *